United States Patent [19]

Voigt

[11] 4,320,283

[45] Mar. 16, 1982

[54] BLOW DRYER WITH HEATER INSIDE STAND

[75] Inventor: Gottfried Voigt, Frankfurt am Main, Fed. Rep. of Germany

[73] Assignee: Braun AG, Kronberg, Fed. Rep. of Germany

[21] Appl. No.: 966,952

[22] Filed: Dec. 6, 1978

[30] Foreign Application Priority Data

Dec. 14, 1977 [DE] Fed. Rep. of Germany ..... 2755698

[51] Int. Cl.[3] ..... H05B 1/00; F24H 3/04; A45D 20/10

[52] U.S. Cl. ..... 219/369; 219/375; 219/367; 219/370

[58] Field of Search ..... 219/368–382; 34/96–98, 243 R; 132/9, 11 R

[56] References Cited

U.S. PATENT DOCUMENTS

| | | | |
|---|---|---|---|
| 1,554,668 | 9/1925 | Wagner | 219/368 |
| 1,868,905 | 7/1932 | Kelley | 219/371 |
| 2,332,639 | 10/1943 | Hudson | 219/370 |
| 2,432,067 | 12/1947 | Morse | 219/369 |
| 2,445,120 | 7/1948 | Levinson et al. | 338/294 |
| 2,614,201 | 10/1952 | Varis | 219/371 |
| 3,322,931 | 5/1967 | Laing | 219/369 |
| 3,397,463 | 8/1968 | Laing | 219/369 |

FOREIGN PATENT DOCUMENTS

| | | | |
|---|---|---|---|
| 568043 | 1/1933 | Fed. Rep. of Germany | 219/373 |
| 486623 | 11/1953 | Italy | 219/370 |
| 1326536 | 8/1973 | United Kingdom | 219/371 |

*Primary Examiner*—B. A. Reynolds
*Assistant Examiner*—Bernard Roskoski
*Attorney, Agent, or Firm*—Karl F. Ross

[57] ABSTRACT

A blow dryer has a housing elongated along an axis and formed with a relatively large head and a slender handle. A two-part centrifugal fan having a hollow interior is mounted in the head and is driven by a motor mounted in the handle. A heater is provided inside the hollow fan. Rotation of the fan by the motor therefore draws air axially in at both ends of the housing, passes the air over the heater inside the fan, and expells the air laterally from the housing.

5 Claims, 3 Drawing Figures

BLOW DRYER WITH HEATER INSIDE STAND

FIELD OF THE INVENTION

The present invention relates to blow dryer. More particularly this invention concerns such a dryer which is meant to be held in the hand and which is used for drying and styling the user's hair.

BACKGROUND OF THE INVENTION

A blow dryer for drying and styling hair normally has a housing formed with a large head and a slim handle. Inside the head is provided a fan which draws air in through an inlet on one side of the head and expels it through a nozzle on the other side of the head. A heater is normally provided in the flow path through the dryer head downstream of the fan. Thus cool air is drawn in through one side of the head, heated, and expelled from the other side.

In order to insure that the output air is of uniform temperature it is normally considered necessary to provide a relatively long nozzle on the outlet. The heated air, some of which has usually been heated to a much higher temperature than the rest, therefore has a chance to mix inside the nozzle to equalize its temperature. When an attempt is made to shorten this nozzle to make the dryer as compact and light as possible, the user will often find that a certain part of the air stream is much hotter than another. In fact one portion of the air stream can be so hot as to damage the user's hair, a common risk run by the user of a blow dryer.

Another disadvantage of the known systems is that the inlet openings, through which the air is aspirated, often can draw in loose strands of hair, and also frequently aspirate airborne chemicals being used to treat the hair. Thus the user might have his or her hair drawn into the blower and pulled out, a highly unpleasant experience, while at the same time the fan inside the blower becomes dirty with hair fragments and miscellaneous chemicals.

OBJECTS OF THE INVENTION

It is therefore an object of the present invention to provide an improved blow dryer.

Another object is the provision of such a blow dryer which can be made extremely compact, in fact without any air-mixing nozzle.

Yet another object is to provide a hair dryer wherein the risk of drawing hair and chemicals into the fan is eliminated.

SUMMARY OF THE INVENTION

These objects are attained according to the instant invention in a blow dryer whose housing is formed with an inlet and an outlet and which is provided with a centrifugal, radial-type fan in the housing having a hollow interior. This fan is rotated to conduct the air from the inlet to the outlet in a path passing through the interior of the fan. According to this invention the heater for the air is provided in the interior of the fan. Thus the heated air will be thoroughly mixed before being ejected from the outlet of the blow dryer, so that this outlet can be provided immediately adjacent the fan, and so that no mixing nozzle may be provided. It is therefore possible to form the blow dryer as an extremely compact wand-type unit.

According to other features of this invention the inlet is provided at one axial end of the housing. In fact it is possible to provide the inlet at the base of the handle, so that the likelihood of aspirating hair or chemicals is largely eliminated.

According to further features of this invention the fan has two parts, the inlet has at least one inlet opening at one end of the housing and at least one other inlet opening at the other end of the housing, so that the flow path actually has two branches each starting at a respective inlet and both terminating at the outlet. In this manner air is drawn axially in both directions through the elongated housing and is expelled transversely. This structure allows the drive motor for the fan to be mounted in the handle along with the control circuit for the heater and/or the motor, so that this motor and the circuit will be cooled by the air passing up through the handle.

In accordance with further features of this invention the fan is formed with a plurality of blades each extending axially in two directions from a central hub. The heater is constituted as a pair of holders or supports over which a heating wire is stretched basket-fashion. Two such heaters may be provided, one to either side of the hub for the fan.

SPECIFIC DESCRIPTION

Figure 1:
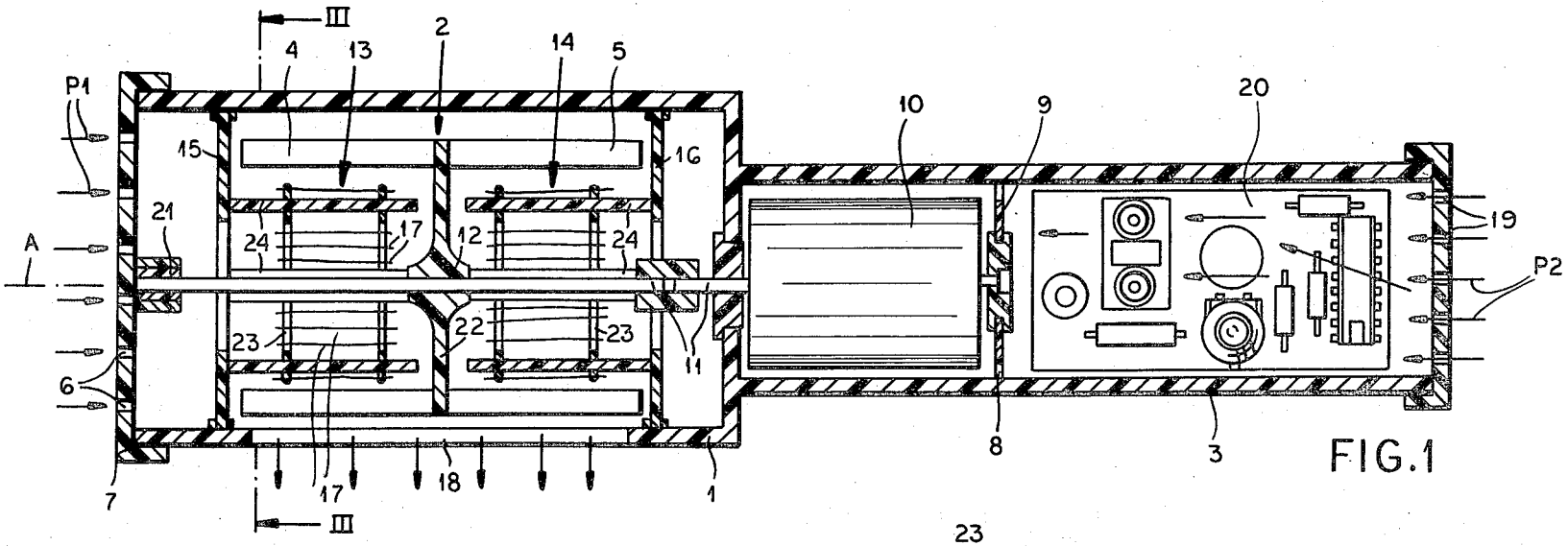
FIG. 1 is an axial section through the blower according to this invention.
Figure 2:
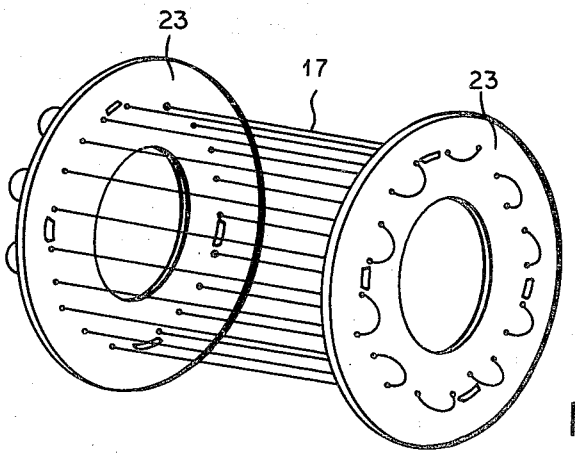
FIG. 2 is a perspective view of one of the heaters of the blower of this invention.
Figure 3:
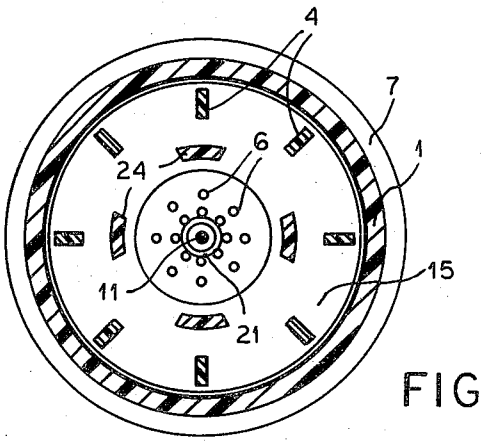
FIG. 3 is a section taken along line III—III of FIG. 1, with the heater removed.

A blow dryer according to this invention has a synthetic-resin housing elongated along an axis A and having a relatively large head 1 and a slim handle 3. The head 1 houses a fan 2 rotatable about the axis A and provided internally with heaters 13 and 14. The handle 3 houses a motor 10 and a control circuit 20 of the type described in the jointly owned patent application 960,756 filed Nov. 14, 1978 by H. Weise (now abandoned). Controls on the handle 3 are connected to the heaters 13 and 14, to the motor 10, and to the circuit 20 in the manner described in that application. These controls are mounted on the back of application 960,715 filed Nov. 14, 1978 by K. H. Hoffmann (now U.S. Pat. No. 4,214,149).

More particularly the motor 10 has a shaft 11 journaled at its far end in a bearing 21 at an end plate 7 covering the top end of the head 1. This shaft 11 carries at its center a hub 12 extending outwardly as a disk 22 carrying vanes 4 and 5 extending axially in opposite directions and forming respective fan parts. In addition the housing is formed at its top end at the end plate 7 with inlet holes 6 and at the bottom of its handle with inlet holes 19. Webs 9 of the housing handle 3 axially flanking the motor 10 are formed with throughgoing holes 8. In addition the head 1 is formed with radially opening outlet slots 18. Thus rotation of the fan 2 by the motor 10 will orbit these vanes 4 and 5 about the axis A so as to draw air in through the holes 6 as indicated by arrows P1 and to draw air in through the holes 19 and along the handle 3 as indicated by the arrows P2. These two branches P1 and P2 of the flow of air through the housing 1, 3 will be joined and exit together at the outlet openings 18.

Each of the heaters 13 and 14 is formed of a pair of annular disks 23 between which a resistance wire 17 is strung basket-fashion. These disks 23 are carried at their inner peripheries on fingers 24 extending from respective mounting supports or holder disks 15 and 16 fitted within the head 1. Thus the air moving along parts P1 and P2 will move respectively through the heaters 13 and 14 downstream of the respective vanes 4 and 5 of the fan 2. The heated air will therefore be very well mixed and of completely uniform temperature before it leaves the housing at the outlet 18, so that no long mixing nozzle need be provided. Furthermore since the air drawn in passes over the circuit 20 and motor 10 the handle 3 will remain relatively cool so that these heat-generating parts can be mounted in this handle 3. As a result the entire hair dryer is of extremely compact wand shape. The centrifugal fan 2 can operate at relatively low speed to provide a current of air that is of a perfectly uniform temperature. As this air is sucked in axially of the housing 1, 3 the likehood of hair becoming caught in the inlet opening is largely eliminated.

I claim:

1. A blow dryer comprising:

a hollow housing extending along an axis, said housing having a slender handle centered on said axis and adapted to fit in a hand, said housing having a large head centered on said axis and carried on said handle, said housing being formed at said head and at said handle with respective axially opening inlets and at said head with a radially opening outlet;

a centrifugal fan centered on and rotatable about said axis in said head and having at said axis a hollow interior, said fan having a central hub at said axis and a plurality of blades secured to said hub offset from said axis and each having one portion extending axially in one direction from said hub and another portion extending axially in the opposite direction from said hub;

drive means in said housing including a motor in said handle for rotating said fan and thereby conducting air in two paths from said inlets to said outlet, one path passing through said handle and over the respective portion of said blades through said interior of said fan, the other path passing from the respective inlet to said interior of said fan, said paths exiting together from said head at said outlet; and a heater centered on said axis in said interior, said heater having a pair of basket-type heater elements axially flanking said hub and lying in the respective paths, whereby the air of each path enters said housing via the respective inlet, passes over the respective heater element, and is displaced by the respective blade portion.

2. The dryer defined in claim 1 wherein said fan has radial blades.

3. The dryer defined in claim 1 wherein said housing has respective webs carrying said heater parts and also axially flanking said hub.

4. The dryer defined in claim 1, further comprising heat-generating circuit means in said handle for controlling the operation of said drive means and said heater, one of said paths passing over said circuit means for cooling same.

5. The dryer defined in claim 1 wherein said heater elements includes a pair of supports in said interior and a resistance-type heating wire strung basket-fashion between said supports.

* * * * *